US008408523B2

(12) United States Patent
Hoggan

(10) Patent No.: US 8,408,523 B2
(45) Date of Patent: Apr. 2, 2013

(54) BALUSTER WITH BEVELED END

(76) Inventor: Patrick R. Hoggan, North Logan, UT (US)

( * ) Notice: Subject to any disclaimer, the term of this patent is extended or adjusted under 35 U.S.C. 154(b) by 1779 days.

(21) Appl. No.: 10/754,156

(22) Filed: Jan. 9, 2004

(65) Prior Publication Data

US 2005/0151124 A1 Jul. 14, 2005

(51) Int. Cl.
*E04H 17/00* (2006.01)

(52) U.S. Cl. ..... 256/1; 256/65.01

(58) Field of Classification Search ..... 256/1, 19, 256/21, 22, 59, 65.01, 65.02, 65.11
See application file for complete search history.

(56) References Cited

U.S. PATENT DOCUMENTS

| | | | | | |
|---|---|---|---|---|---|
| 4,722,514 | A | * | 2/1988 | Pettit | 256/50 |
| 4,928,930 | A | * | 5/1990 | Chung | 256/67 |
| 5,025,842 | A | * | 6/1991 | Brimhall | 144/367 |
| 5,626,331 | A | * | 5/1997 | Erwin | 256/59 |
| 5,695,175 | A | * | 12/1997 | Hawkins | 256/67 |

FOREIGN PATENT DOCUMENTS

| | | | |
|---|---|---|---|
| GB | 2 070 664 | * | 9/1981 |
| JP | 54-13637 | * | 2/1979 |

* cited by examiner

*Primary Examiner* — Michael P Ferguson
(74) *Attorney, Agent, or Firm* — Fehr Law Firm; Thompson E. Fehr

(57) ABSTRACT

A baluster with beveled end having, near one or both ends of the baluster, the perimeter of the baluster proceed increasingly more inward as such end of the baluster is approached. There is some indentation at all points along the perimeter, although such indentation need not necessarily be uniform.

22 Claims, 3 Drawing Sheets

BALUSTER WITH BEVELED END

BACKGROUND OF THE INVENTION

1. Field of the Invention

This invention relates to balusters which extend from a hand rail to a bottom rail, shoe rail, step, or floor.

2. Description of the Related Art

Numerous patents exist for balusters.

These include U.S. Pat. Nos. 4,272,061; 4,344,604; 4,352,485; 4,403,767; 4,421,302; 4,533,121; 4,928,930; 5,056,283; and 5,340,087.

Of these, four (U.S. Pat. Nos. 4,272,061; 4,421,302; 5,056,283; and 5,340,087) have a portion of the perimeter of the baluster near one or more ends of the baluster proceed increasingly more inward as such end of the baluster is approached. None, however, have the entire perimeter of the baluster proceed increasingly more inward as an end of the baluster is approached.

Furthermore, the primary reason for this indentation in the balusters of these four patents is to accommodate a sloping hand rail while the balusters remain vertical on a stairway. There would, consequently, be no reason to extend the indentation.

In U.S. Pat. No. 5,340,087 each end of the baluster is formed with a first edge eliminated, creating an angled face; and a second edge of that end of the baluster is chamfered to facilitate pivoting of the hand rail (and, at the other end of the baluster, the stair rail or base rail) with respect to that end of the baluster. Lines 19 through 22 in column 3 of U.S. Pat. No. 5,340,087 observe, "In the case of a non-rectangular baluster such chamfering will need to be progressive around the upper side of the baluster." The chamfering simply removes excess material which would otherwise preclude the hand rail (or stair or base rail) from resting against the entire length of the angled face. For a baluster which has a rectangular cross section at and near the end of the baluster, this would indicate that maximum chamfering would occur at the point of the perimeter farthest from the angled face and that, at the two points where the perimeter meets the angled face, there would be no chamfering because no excess material would exist at those two points. Hence, at such two points there would be no indentation of the perimeter.

BRIEF SUMMARY OF THE INVENTION

For the purposes of this invention, the term "beveled" means that, near one or both—but preferably both—ends of a baluster, the perimeter of the baluster proceeds increasingly more inward as such end of the baluster is approached. The slanted surface created by such inward movement may, when viewed in a plane containing the longitudinal axis of the baluster, be either straight or curved.

And the Baluster with Beveled End of the present invention has each edge of one, and preferably both, ends of the baluster so beveled, i.e., there must be some indentation at all points along the perimeter.

The indentation need not, however, be, but preferably is, the same all around the perimeter.

The top end of a baluster is generally placed within a cavity in an upper (or hand) rail. Similarly, the bottom end of a baluster is usually placed within a cavity in a lower (or bottom or stair or base) rail. The cross-sectional dimensions of such cavities are traditionally selected to be close to those of the un-beveled ends of the baluster in order to provide a snug fit. Consequently, considerable time is spent by a craft person in aligning the end of the baluster with the cavity before such end can be placed within the cavity.

The bevel on each edge of the baluster enables the craft person to work faster because any error in alignment that is within the maximum indentation will not preclude the baluster from entering the hole. As the craft person pushes the end of the baluster into the cavity, the bevel will simply cause the baluster to move in the necessary lateral direction.

DETAILED DESCRIPTION OF THE INVENTION

Figure 1:
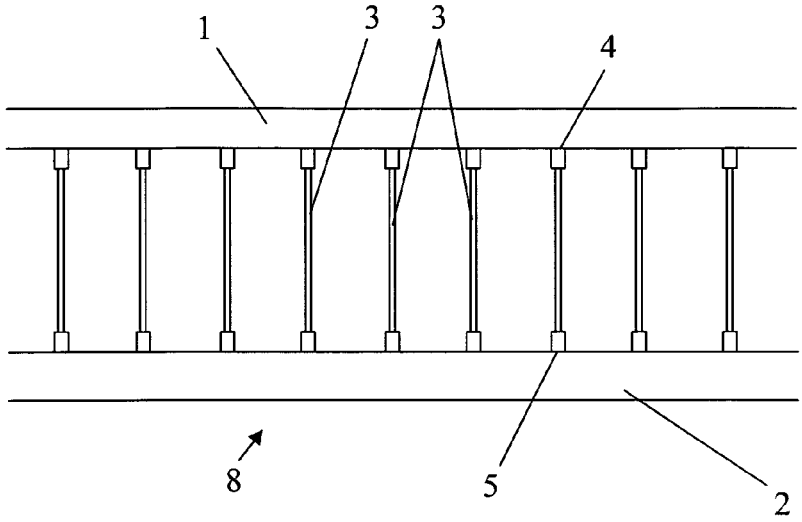
FIG. 1 illustrates a balustrade.

As is apparent from the preceding, it has become well known to have an upper rail 1 and a lower rail 2 joined by posts 3 (termed "balusters" or "spindles") which have an upper end 4 and a lower end 5 inserted into a cavity 6 in the upper rail 1 and a cavity 7 in the lower rail 2, respectively, in order to create a balustrade 8 as seen in FIG. 1.

Figure 2:
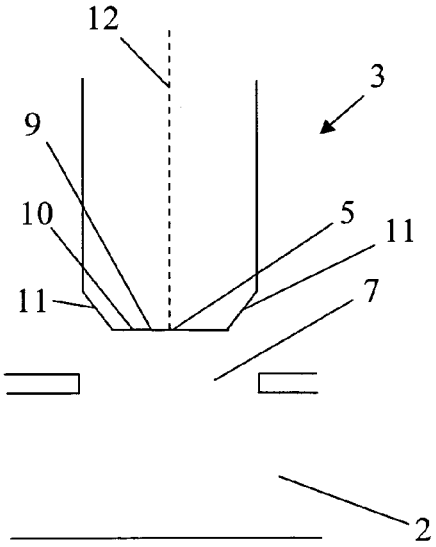
FIG. 2 shows, in a cutaway view, a beveled lower end of a baluster having a straight slanted surface about to enter a cavity in a lower rail.
Figure 3:
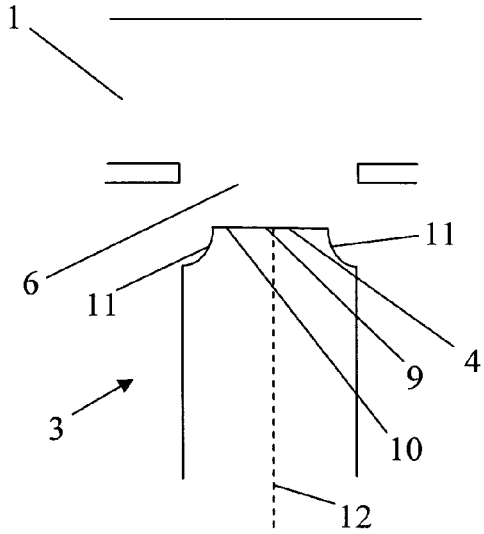
FIG. 3 portrays, in a cutaway view, a beveled upper end of a baluster having a curved slanted surface approaching a cavity in an upper rail.

The present invention improves the baluster 3 used in such a balustrade 8 by beveling each edge 9 of one end 4 or 5 or, preferably, both ends 4, 5 of the baluster 3, as can be seen in FIG. 2 where a beveled lower end 5 of a baluster 3 is about to enter a cavity 7 in a lower rail 1 and in FIG. 3 where a beveled upper end 4 of a baluster 3 is approaching a cavity 7 in an upper rail 2.

As observed above, the indentation which creates the bevel need not be, but preferably is, the same at a given distance from the end 4 or 5 all around the perimeter 10 of the baluster 3; but there must be some indentation at all points along the perimeter 10, otherwise the improved invention would not achieve its purpose of eliminating the need for precise alignment when placing and end 4 or 5 of a baluster 3 into a cavity 7. (At each end 4, 5 of the baluster 3, the perimeter 10 is, of course, composed of all the edges 9 of a given end 4 or 5.)

Figure 4:
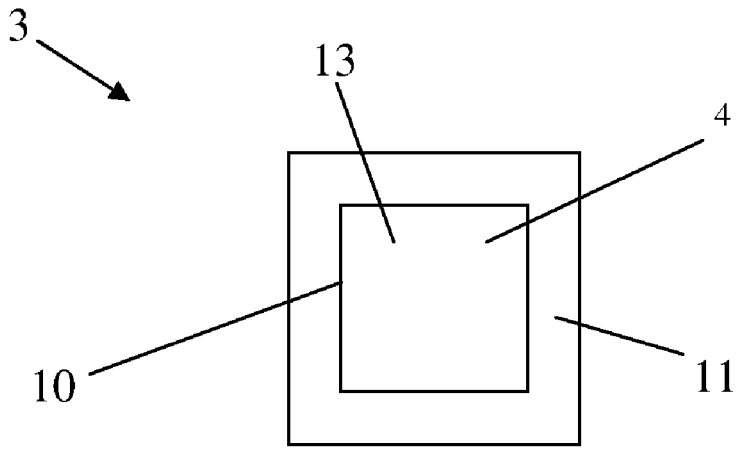
FIG. 4 is a plan view of an upper end of a baluster with a square cross section where the baluster has a beveled upper end and where the degree of indentation is the same all around the perimeter of the upper end of the baluster.
Figure 5:
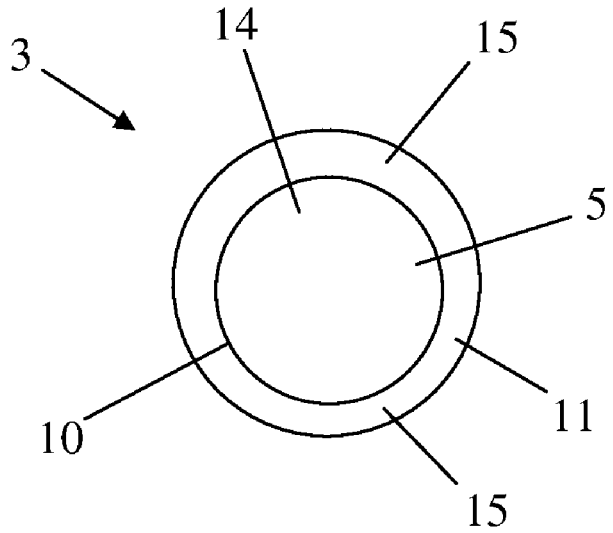
Figure 6:
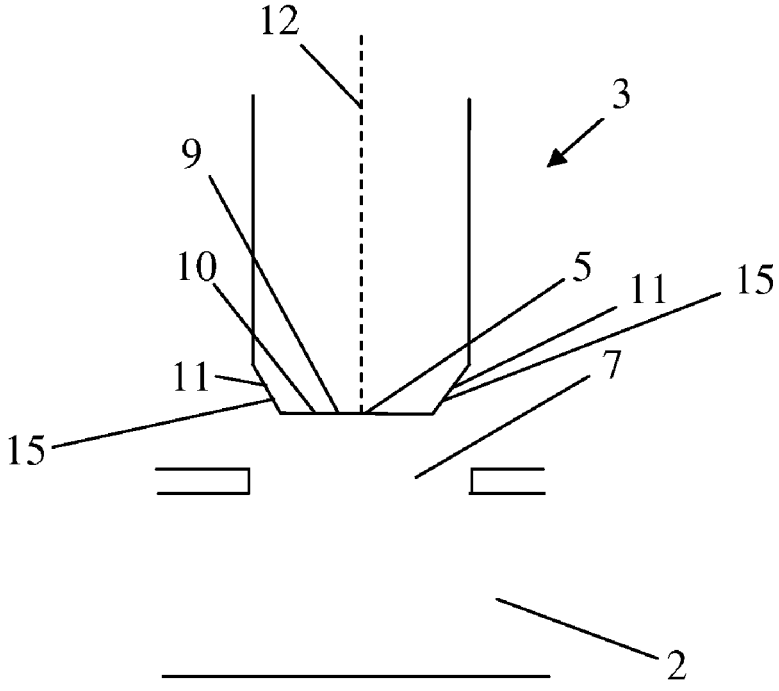
FIG. 6 shows, in a cutaway view, a beveled lower end of a baluster with the degree of indentation varying around the perimeter of the lower end of the baluster and with such lower end about to enter a cavity in a lower rail.
Figure 7:
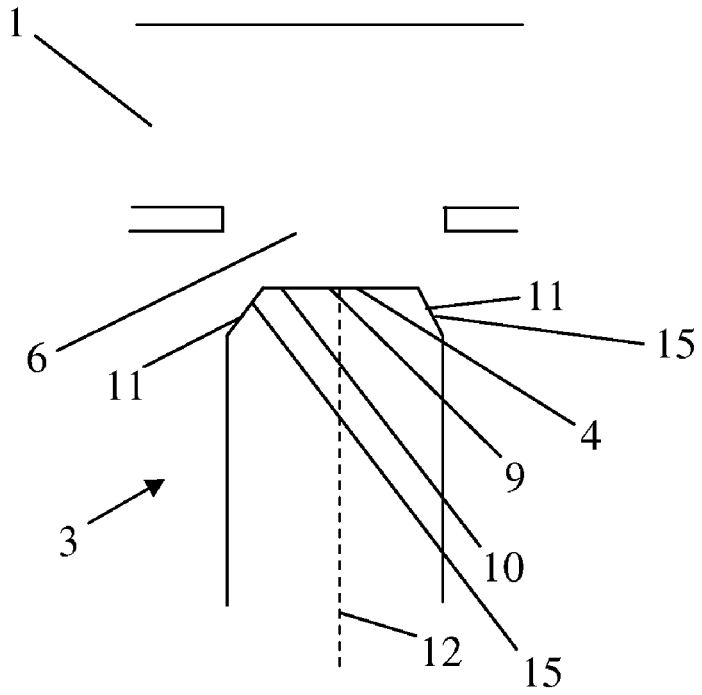
FIG. 7 portrays, in a cutaway view, a beveled upper end of a baluster with the degree of indentation varying around the perimeter of the upper end of the baluster and with such lower end about approaching a cavity in an upper rail.

Furthermore, as noted above, the slanted surface 11 created by the beveling may, when viewed in a plane containing the longitudinal axis 12 of the baluster 3, be either straight (There is a linear relationship between the indentation and the distance to the end 4 or 5.), as shown in FIG. 2, or curved (There is a nonlinear relationship between the indentation and the distance to the end 4 or 5.), as illustrated in FIG. 3 (Of course the shape of the curve may vary; for example, it could be either convex or concave.). And the shape of the cross section 13, 14 of the ends 4, 5 of the baluster 3 is immaterial. FIG. 4 illustrates, for example, an upper end 4 of a baluster 3 with a square cross section 13 where the degree of indentation is the same all around the perimeter 10 of the baluster 3 at a given distance from the upper end 4 whereas FIG. 5 depicts a lower end 5 of a baluster 3 with a circular cross section 14 where the degree of indentation 15 varies around the perimeter 10 of the baluster 3 at a given distance from the lower end 5. If desired, although not preferred, the shape of the cross section 13 of the upper end 4 can differ from the shape of the cross section 14 of the lower end 5. (The indentation 15 that forms the slanted surface 11 adjacent to the lower end 5 of the baluster 3 that varies around the perimeter 10 of the baluster 3 is also shown in FIG. 6. And the indentation 15 that forms the slanted surface 11 adjacent to the upper end 4 of the baluster 3 that varies around the perimeter 10 of the baluster 3 is shown in FIG. 7.)

The material of which the baluster is composed can be any material that is known in the art, such as wood, metal, plastic, or a composite. Preferably, though, the material is polyvinyl chloride (PVC). The PVC can be made with any technique that is well known in the art, such blow molding (being placed in a mold, heated, and subjected to air blown inside it), roto molding, or injection molded.

As used herein, the term "preferable" or "preferably" means that a specified element or technique is more acceptable than another but not that such specified element or technique is a necessity.

I claim:

1. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster, wherein:

the slanted surface adjacent to the lower end of the baluster is curved, when viewed in a plane containing the longitudinal axis of the baluster.

2. The improved baluster as recited in claim 1, wherein:

the indentation that forms the slanted surface adjacent to the lower end of the baluster is the same all around the perimeter of the baluster at a given distance from the lower end of the baluster.

3. The improved baluster as recited in claim 2, wherein:

the cross-sectional shape of the lower end of the baluster is square.

4. The improved baluster as recited in claim 2, wherein:

the cross-sectional shape of the lower end of the baluster is circular.

5. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster;

the baluster, near the upper end of the baluster, is beveled, by indentation, at every point along the perimeter of the baluster, thereby creating a slanted surface adjacent to the upper end of the baluster; and the slanted surface adjacent to at least one of the ends of the baluster is curved, when viewed in a plane containing the longitudinal axis of the baluster.

6. The improved baluster as recited in claim 5, wherein:

for at least one of the slanted surfaces the indentation that forms the slanted surface is the same all around the perimeter of the baluster at a given distance from the end of the baluster to which that slanted surface is adjacent.

7. The improved baluster as recited in claim 6, wherein:

the cross-sectional shape of at least one end of the baluster is square.

8. The improved baluster as recited in claim 6, wherein:

the cross-sectional shape of at least one end of the baluster is circular.

9. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster;

the baluster, near the upper end of the baluster, is beveled, by indentation, at every point along the perimeter of the baluster, thereby creating a slanted surface adjacent to the upper end of the baluster;

the slanted surface adjacent to at least one of the ends of the baluster is curved, when viewed in a plane containing the longitudinal axis of the baluster; and the baluster is composed of polyvinyl chloride.

10. The improved baluster as recited in claim 9, wherein:

for at least one of the slanted surfaces the indentation that forms the slanted surface is the same all around the perimeter of the baluster at a given distance from the end of the baluster to which that slanted surface is adjacent.

11. The improved baluster as recited in claim 10, wherein:

the cross-sectional shape of at least one end of the baluster is square.

12. The improved baluster as recited in claim 10, wherein:

the cross-sectional shape of at least one end of the baluster is circular.

13. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster;

the slanted surface adjacent to the lower end of the baluster is curved, when viewed in a plane containing the longitudinal axis of the baluster; and the baluster is composed of polyvinyl chloride.

14. The improved baluster as recited in claim 13, wherein:

the indentation that forms the slanted surface adjacent to the lower end of the baluster is the same all around the perimeter of the baluster at a given distance from the lower end of the baluster.

15. The improved baluster as recited in claim 14, wherein:

the cross-sectional shape of the lower end of the baluster is square.

16. The improved baluster as recited in claim 14, wherein:

the cross-sectional shape of the lower end of the baluster is circular.

17. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster;

the baluster, near the upper end of the baluster, is beveled, by indentation, at every point along the perimeter of the baluster, thereby creating a slanted surface adjacent to the upper end of the baluster;

the slanted surface adjacent to at least one of the ends of the baluster is curved, when viewed in a plane containing the longitudinal axis of the baluster;

for at least one of the slanted surfaces the indentation that forms the slanted surface is the same all around the perimeter of the baluster at a given distance from the end of the baluster to which that slanted surface is adjacent;

the cross-sectional shape of at least one end of the baluster is square; and the baluster is composed of polyvinyl chloride.

18. An improved baluster having a perimeter, an upper end with a cross-sectional shape, a lower end with a cross-sectional shape, and a longitudinal axis, wherein the improvement comprises:

the baluster, near the lower end of the baluster, being beveled, by indentation, at every point along the perimeter of the baluster, thereby creating a slanted surface adjacent to the lower end of the baluster;

the baluster, near the upper end of the baluster, is beveled, by indentation, at every point along the perimeter of the baluster, thereby creating a slanted surface adjacent to the upper end of the baluster;

the slanted surface adjacent to at least one of the ends of the baluster is curved, when viewed in a plane containing the longitudinal axis of the baluster;

for at least one of the slanted surfaces the indentation that forms the slanted surface is the same all around the perimeter of the baluster at a given distance from the end of the baluster to which that slanted surface is adjacent;

the cross-sectional shape of at least one end of the baluster is circular; and the baluster is composed of polyvinyl chloride.

19. An improved baluster having a perimeter, an upper end with a cross-sectional shape, a lower end with a cross-sectional shape, and a longitudinal axis, wherein the improvement comprises:

the baluster, near the upper end of the baluster, being beveled, by indentation, at every point along the perimeter of the baluster, thereby creating a slanted surface adjacent to the upper end of the baluster; and the slanted surface adjacent to the upper end of the baluster is curved, when viewed in a plane containing the longitudinal axis of the baluster.

20. The improved baluster as recited in claim 19, wherein:

the indentation that forms the slanted surface adjacent to the upper end of the baluster is the same all around the perimeter of the baluster at a given distance from the upper end of the baluster.

21. The improved baluster as recited in claim 20, wherein:

the cross-sectional shape of the upper end of the baluster is square.

22. The improved baluster as recited in claim 20, wherein:

the cross-sectional shape of the upper end of the baluster is circular.

* * * * *